US010065197B2

(12) United States Patent
Richmond et al.

(10) Patent No.: US 10,065,197 B2
(45) Date of Patent: Sep. 4, 2018

(54) HYDRAULIC PARTICLE SEPARATION APPARATUS FOR PLACER MINING

(71) Applicants: John Richmond, Albany, OR (US); Michael Lee Gray, Albany, OR (US)

(72) Inventors: John Richmond, Albany, OR (US); Michael Lee Gray, Albany, OR (US)

( * ) Notice: Subject to any disclaimer, the term of this patent is extended or adjusted under 35 U.S.C. 154(b) by 0 days.

(21) Appl. No.: 15/461,272

(22) Filed: Mar. 16, 2017

(65) Prior Publication Data

US 2018/0015479 A1 Jan. 18, 2018

Related U.S. Application Data

(60) Provisional application No. 62/361,104, filed on Jul. 12, 2016.

(51) Int. Cl.

| | |
|---|---|
| ***B03B 5/66*** | (2006.01) |
| ***B03B 5/62*** | (2006.01) |
| ***B03B 13/00*** | (2006.01) |
| ***B03B 9/00*** | (2006.01) |
| *B03B 11/00* | (2006.01) |

(52) U.S. Cl.

CPC ..... *B03B 5/62* (2013.01); *B03B 9/00* (2013.01); *B03B 13/00* (2013.01); *B03B 2011/002* (2013.01)

(58) Field of Classification Search

CPC ..... B03B 5/62; B03B 9/00; B03B 13/00
USPC ..... 209/155, 159
See application file for complete search history.

(56) References Cited

U.S. PATENT DOCUMENTS 2,102,525 A * 12/1937 Freeman ..... B04C 5/081 209/731
3,851,404 A * 12/1974 Fracke ..... B01F 5/0062 159/4.06
4,151,087 A * 4/1979 Sakaguchi ..... B01D 17/045 210/109
4,371,382 A * 2/1983 Ross ..... B01D 3/30 159/49
4,511,474 A * 4/1985 Krishna ..... B04C 5/00 210/512.1
4,670,161 A * 6/1987 Hayatdavoudi ..... B04C 5/13 209/726
4,872,973 A * 10/1989 Ikebuchi ..... B04C 5/10 209/154
5,120,165 A * 6/1992 Walko, Jr. ..... B65G 53/24 406/171
5,275,788 A * 1/1994 Stoholm ..... B01J 8/1854 110/245
5,824,210 A * 10/1998 Kuryluk ..... B01D 21/283 209/3

(Continued)

*Primary Examiner* — Terrell H Matthews
(74) *Attorney, Agent, or Firm* — Scott E. Gilbert

(57) ABSTRACT

A hydraulic particle separator is described. The particle separator comprises a main body having a top, a bottom, and a wall enclosing an interior cavity. At least one feed port is disposed on the top of the main body to introduce crude particle mixtures. A partition disposed within the cavity separates the cavity into a lower chamber and an upper chamber. The partition has at least one orifice for fluidic communication between the upper chamber and lower chamber. One or more grooves extend vertically along the interior surface of the wall. At least one tangential flow inlet port is disposed along the wall of the upper chamber above the partition.

14 Claims, 9 Drawing Sheets

(56) References Cited

U.S. PATENT DOCUMENTS 6,109,451 A * 8/2000 Grimes ..... B04C 3/00
209/725
7,128,882 B2 * 10/2006 Tamata ..... B01D 53/68
422/177

* cited by examiner

HYDRAULIC PARTICLE SEPARATION APPARATUS FOR PLACER MINING

CROSS REFERENCE TO PRIORITY APPLICATION

This U.S. non-provisional application claims priority to U.S. Provisional Application No. 62/361,104, filed on Jul. 12, 2016, which is incorporated herein by reference in its entirety.

FIELD OF THE INNOVATION

This innovation relates to high efficiency hydraulic gravitational particle separators for use in suction dredging, panning and other applications of solid particle separations by hydraulic means.

BACKGROUND

Alluvial or placer gold prospecting and mining conventional methods include panning, sluice box and more recently, suction dredging of placer deposits found in stream beds, creek beds and river beds. The latter method has become popular among recreational as well as professional placer gold mining and prospecting enthusiasts. The method involves suction to pull silt material from the benthic zones of streams, creeks and river bottoms into a suction hose via a pumping means, and onto a sluice box for separation of silt components by specific gravity or density. As an example, a typical suction dredging apparatus used for placer gold mining comprises a pump, which is often disposed on floating platform or raft. The bottom material comprises a fine silt composed primarily of silica sand and other finely divided minerals. Stones and pebbles of various sizes are also present. A suction hose is used to aspirate, or "vacuum" the bottom silt and small pebbles to a gold recovery system, such as a portable sluice box, may also be mounted on the same floating platform. In some configurations, the sluice box is assembled on the bank of the river, creek or stream, and is built as a permanent or semi-permanent structure on the shore.

In portable suction dredging operations, the sluice box has a short run, and may not be efficient. Siltification takes place as the silt effluent of the sluice box drops back into the water. This, in addition to the disruption of benthic and riparian habitat, current suction dredging practice creates serious environmental destruction for fish and other aquatic wildlife. Siltification causes increased turbidity, as well as release of toxic metals such as mercury into the water column. The state of California has already banned suction dredging in most streams and creeks to protect endangered aquatic species as well as cultural resources. While current suction dredging practices are damaging to the environment, improvements can be made by introduction of equipment of improved design and function to avoid many of the issues that threaten the continuation of the practice. In particular, significant reduction of siltification and bottom disruption is needed.

Panning is an ancient and popular form of batch prospecting of placer deposits for gold and precious stones and minerals. In contrast to suction dredging, it requires only a pan designed for the purpose. As an entirely manual prospecting technique, it is a slow and low yield process.

SUMMARY

The instant innovation is a novel hydraulic gravity particle separation apparatus for highly efficient hydraulic force field separations of high density particulates from lower density particulates in solids-liquid suspensions, to enhance placer deposit mining or general separation of particles by specific gravity differences. High-density particulates, or particulates having high specific gravity, comprise precious metals such as gold, lead, silver, copper brass, hafnium and mercury, while lower density particulates comprise silica, gravel, magnetite sand, clays, organic matter, and other mineral particles that are found in placer deposits, riparian stream beds and ocean sediments.

By way of example, the density of gold is 19 g/cm$^3$, comprise the highest density (specific gravity) particulates; lead, 11 g/cm3, silver, 10.4 g/cm3, copper, 10 g/cm3, mercury 13.5 g/cm3, and halfnium 13.3 g/cm3, comprise medium-density particulates. The density of silica may range from 2.2-2.7 g/cm$^3$, being a component of the lowest-density particulates. Alumina has a density of approximately 4 g/cm$^3$. River bottom silt, for example, has a composition made up primarily of quartz and feldspar (source of alumina and aluminosilicate $AlSi_3O_8$) as the main mineral composition of the silt particulate matter.

Clays and organic matter are also included in more minor abundances. Both main minerals have a density between 2.2 and 2.7 g/cm$^3$. Silica derived from quartz is the most abundant mineral found in riverbottom silt composition. In traditional methods of placer deposit prospecting, such as sluice box classifying and panning, gold particles are commonly mixed with black sand, comprising primarily magnetite. This mineral has a density of approximately 5 g/cm$^3$.

It is an object of the innovation to accomplish a high-efficiency particulate separation in a compact volume. Embodiments of the innovation described herein include a substantially upright cylindrical tank, forming a separator main body. In most embodiments, the main body is characterized by a cylindrical or conduit-like form factor, having a top, a bottom an inner partition forming a demarcation and physical separation between an upper chamber and a lower chamber. The inner partition comprises at least one orifice, allowing fluidic communication between the upper and lower chambers. By "fluidic communication" it is meant gaseous or liquid flow or transfer between the upper and lower chambers via the one or more orifices in the partition.

The function of the partition is to gather the highest-density particulates that fall by gravity from the separation process occurring in the upper chamber of the separation apparatus, and facilitate them to drop into the lower chamber. Embodiments of the innovation comprise a collection vessel affixed to the bottom of the separator main body for collecting the newly separated high-density particulates. In some embodiments, the collection vessel is removably affixed to the bottom of the separator main body. In other embodiments, the collection vessel is permanently affixed to the separator main body, and may be emptied by decantation or suction via an attached hose or tube.

As mentioned earlier, in particular embodiments, the upright tank of the separator main body is substantially cylindrical or tubular, having a cavity or hollow interior, surrounded by the wall of the upright tank. The separator main body may have a circular cross section or an elliptical cross section. In particular embodiments, the partition is substantially conical, and coaxial with the cylindrical main body of the separator. By "coaxial" it is meant that the axis extending through the apex of the conical separator is parallel with the central axis of the cavity of the separator main body.

In other embodiments, the partition may not be coaxial with the main body of the separator. In particular embodiments, the conical partition may be substantially a funnel, having a tapered or sloping bottom portion with an apex opening to a central orifice, from which a tubular appendage or duct extends downward from the central orifice and into the lower chamber of the separator cavity. The funnel form factor of the partition facilitates gathering of high-density particulates falling out of the separation process occurring above the partition in the upper chamber, and efficiently conveying them into the lower chamber.

In other embodiments, the partition may be substantially flat or have a slope, either symmetrically arranged about the central axis, or disposed asymmetrically with respect to the central axis. For example, in other embodiments, the partition is a flat disc that separates the upper and lower chambers, but is tilted in one direction to allow settling high-density particles to slide towards an orifice that may be disposed at the bottom of the slope against the wall of the main body of the separator.

In some embodiments of the instant innovation, a funnel-shaped hopper is affixed at the top of the separator main body, and is provided for manually introducing silt or particle mixtures to the innovative particle separator apparatus in batches, or receive material from a dredge. The hopper is in fluidic communication with the upper chamber of the apparatus via a downspout duct or tube. For placer mining applications, the function of the hopper is to receive untreated silt either dug, dredged or otherwise gathered from a placer deposit, and feed this raw material into the upper chamber of the apparatus. In particular embodiments, the hopper may be a removable pan having a tapered or sloping bottom that converges at an orifice from which a tube extends downward into the upper chamber of the cavity. In other embodiments, the hopper may comprise a flat pan or box.

In certain embodiments, the hopper may be removably affixed to an adapter. The function of the hopper is to receive untreated silt either dug, dredged or otherwise gathered from a placer deposit, and feed this raw material into the upper chamber of the cavity. Embodiments of the hopper may comprise a simple conical pan that is manually fed or fed by conveyer from a dredging apparatus. In other embodiments, the hopper may comprise mechanical accoutrements such as an auger to facilitate dislodgement of the charged material into the upper chamber.

In further embodiments, the hopper directly affixed on the innovative separation apparatus is replaced, wherein the adapter is adapted to mate with a hose fitting or mate with a metal or plastic pipe or tubing, where the placer silt or dirt is pumped as a slurry to enter the upper chamber of the instant separator during operation of a slurry pump for suction mining operations. In yet further embodiments, an auger screw conveyer apparatus may be affixed to the adapter configured to accept an auger spout or connecting tube or pipe.

An aspect of the innovation is the creation of upward spiral or cyclonic flow patterns within the upper chamber of the cavity to facilitate particle separation. According to the innovation, the upward spiral or cyclonic flow carries the lower-density particles to the top of the apparatus, and at the same time uses centrifugal force to drive particles toward the wall. Lightweight low density particles are carried out of the apparatus via an exit port, whereby the lower density particles are entrained in the upward spiral flow, while the high-density particles are not entrained by the impinging upward flow. However, the high-density particles may be entrained by the lateral forces of the spiral flow, which then may drive these particles toward the wall where the velocity of the flow decreases along with the force of the flow, causing the high-density particles to fall to collect on the partition stage at the base of the upper chamber, under the influence of gravity.

According to the innovation, in order to engender the upward spiral flow within the upper chamber, a tangential flow inlet is affixed to the separator body above the level of the partition, where tangential flow of a fluid, such as water, is introduced into the upper chamber of the cavity. By "tangential flow", it is meant a jet of liquid, (water), introduced via the tangential flow inlet into the cavity of the upper chamber, such that the streamlines of the entering flow are directed away from the center of the chamber, and substantially along a chord of the cavity near the wall, where the chord is substantially offset from the center of the cavity, and may be substantially tangent to the inner surface of the wall.

The tangential inlet port introduces a jet that evolves into a circulating flow around the wall. According to the innovation, a second flow inlet port is provided within the lower chamber, whereby a second flow is introduced into the cavity of the lower chamber. The second flow need not be tangential, and in particular embodiments is directed towards the center. In all embodiments of the innovation, the second inlet port is disposed below the level of the partition. The flow introduced by the second inlet port may be tangential or non-tangential, but it engenders an upward vertical flow through the one or more orifices of the partition in the upper chamber once the lower chamber is filled. In continuous operation of the innovative separator apparatus, an upward vertical flow is present in the upper chamber, mixed with the tangential flow to create an upwardly spiral flow pattern in the upper chamber. In specific embodiments, the vertical flow may have a lower flow velocity than that of the tangential flow. In featured embodiments of the innovation, liquid entering the lower chamber of the cavity flows into the upper chamber through the at least one orifice of the partition. In particular embodiments, the partition is substantially conical, and the lower chamber enters the upper chamber by flowing upwardly through the downspout tube or duct that extends below the partition.

In these embodiments, the second flow inlet may be disposed below the level of the downspout mouth, but may otherwise be disposed above this level. Accordingly, the upward vertical flow entering the upper chamber encounters the tangential flow introduced in the upper chamber via the tangential flow inlet, causing an upwardly spiraling flow to form. The fluid force of the upward flow through the partition orifice is such that it does not significantly impede or overcome the gravitational force causing the high-density particulates to drop downwardly through the partition orifice, and extension duct or tube extending below the partition if one is so equipped. By adjusting the flow rates, the fluid forces are adjusted to obtain a desired gravitational separation of particulates having disparate specific gravities, such as gold particles, small nuggets and flakes from silt components, mostly clays and silicates, mixed with small gravel.

The upward spiral flow engendered in the upper chamber imposes a centrifugal force to the particulates introduced into the upper chamber, causing lower-density particulates to spin laterally as well as being carried upward by vertical fluid forces. High-density particulates as well as lower-density particulates may be flung against the wall's inner surface by the centrifugal forces, where the velocity of the spiral flow, as well as the purely vertical flow component, is the lowest. In the region of the wall, the high-density particles, substantially not entrained in the vertical flow as are the lower-density particulates, may then accumulate against the inner surface of the wall and slide down the wall under the influence of gravity, or sink in the bulk region of liquid nearest to the wall. In particular embodiments of the innovation, one or more longitudinal grooves are formed along the inner surface of the wall, encompassing the upper chamber of the cavity. The grooves may vary in depth and length.

In particular embodiments, the one or more grooves extend downward along the inner surface of the wall in the upper chamber to the level of the partition. In some embodiments, the one or more grooves extend along the top surface of the partition as well. In particular embodiments of the conical partition, grooves are formed in the upper surface of the partition that extend from the inner surface of the wall to terminate at the edge of the central orifice. The one or more grooves of the partition may be aligned with the one or more grooves disposed along the inner surface of the wall of the upper chamber. The one or more grooves formed in the walls and the partition may serve to channel slow-moving high-density particulates flung against the wall by the spiral flow of the upper chamber. In other embodiments, other partition shapes such as a flat disc may also comprise grooves leading to an orifice in order to direct non-buoyant particulates into the lower chamber. In yet other embodiments, no grooves are disposed on the partition.

In all embodiments of the innovative separator apparatus, at least one outlet is provided to allow the upward flow and entrained lower density particles to exit the apparatus. Furthermore, in particular embodiments, a valve may be included and disposed in proximity of the bottom of the separator main body, having the function to seal off the separator main body when the collection vessel may be either removed or drained. The valve may be, by way of example, a butterfly, ball or gate valve.

DETAILED DESCRIPTION

Figure 1:
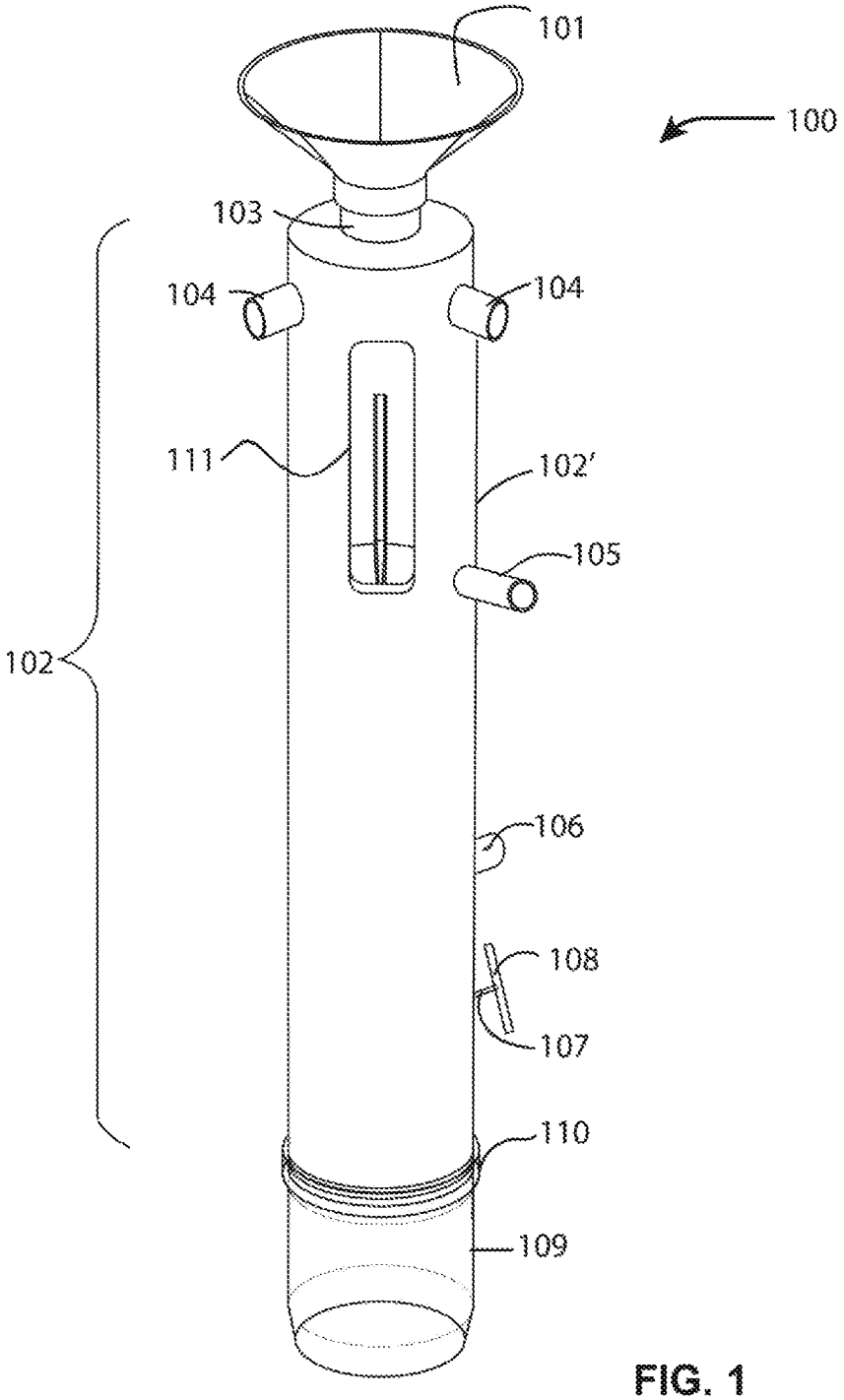
FIG. 1. Perspective view of a featured embodiment of the innovative particle separator apparatus, as viewed from the exterior.

FIG. 1 shows a first exterior view of a particular embodiment of particle separator 100. Hopper pan 101 is disposed above the top of the main body 102 of the innovative separator, which in some embodiments is a vertical cylindrical housing. In some embodiments, main body 102 has a tubular shape, comprising wall 102' that surrounds cavity 112. In some embodiments, cavity 112 extends from the top of main body 102 to the bottom of main body 102. In the illustrated embodiment, hopper pan 101 is affixed to the top of main body 102 by various means, and is shown to connect to main body 102 by feed inlet port 103 that extends through the top of main body 102 into cavity 112. In some embodiments, hopper pan 101 is funnel-shaped. Hopper pan 101 may be employed to receive batches of raw dirt or silt that is dug from a river bed or bank, and feed the raw dirt or silt into cavity 112 of main body 102. In some embodiments, feed inlet port 103 receives a conduit directing a pumped stream, where hopper pan 101 is replaced by the conduit (described below).

Also shown in FIG. 1 are multiple conduits, protruding from wall 102' of main body 103 and open to cavity 112. In some embodiments, outlet 104 extends from main body wall 102' in proximity of the top of main body 102. Tangential flow inlet 105 extends from the middle portion of wall 102' of main body 102. Lower flow inlet 106 extends from main body wall 102' below tangential flow inlet 105. Below lower flow inlet 106 is valve stem 107 and handle 108. Valve stem 107 extends through main body wall 102' to operate an interior valve (e.g., valve 211 in FIG. 2) disposed in lower portion of the main body 102, as described below.

In some embodiments, collection vessel 109 is attached to the bottom of main body 102. In the embodiment shown in FIG. 1, vessel 109 is affixed to main body 102 by a threaded interface 110. In other embodiments, a flange is employed to bolt vessel 102 to main body 102 (described below). Also shown in the embodiment of FIG. 1 is a view window 111 to the interior of main body 102, substantially disposed in the upper chamber of main body 102.

Figure 2:
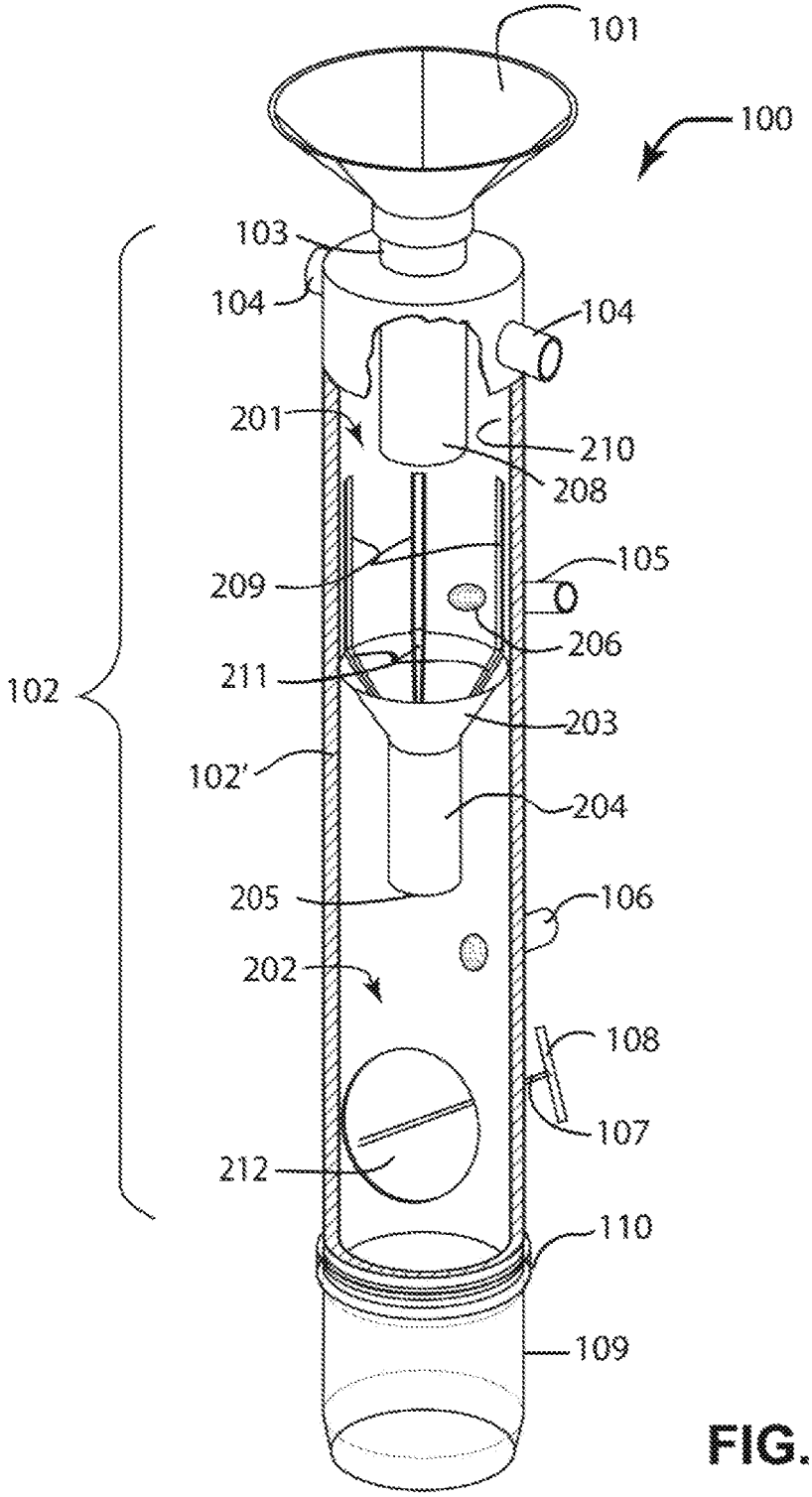
FIG. 2. Perspective partial sectional view of a featured embodiment of the innovative particle separator apparatus, exposing interior features.

In FIG. 2, the interior features of the innovative single-stage particle separator are shown in the sectional view of particle separator 100. Cavity 112 of main body 102 is shown encased by wall 102', surrounding cavity 112 having an upper chamber 201 and a lower chamber 202. In some embodiments, upper and lower chambers 201 and 202 are divided by partition 203, having at least one orifice (e.g., orifice 301 in FIGS. 3*a*, 3*b* and 4) allowing fluidic communication between upper and lower chambers 201 and 202.

In some embodiments, partition 203 may be substantially conical in shape, however in other embodiments, partition 203 may be substantially flat or have other shapes that facilitate its functionality. The means of attachment of partition 203 to wall 103 of main body 102 are various, and may range from casting techniques, welding or gluing the partition to an internal receiving structure such as a flange, or force fitting. In some embodiments, a welded seam or joint is present about the upper rim of partition 203 where it joins wall 102'.

In the illustrated embodiment shown in FIG. 2, partition 203 is shown to be substantially conical-shaped, with downspout 204 extending below into the lower chamber 202. Lower flow inlet 106 is disposed below the level of mouth 205 of downspout 204. In some embodiments, this particular arrangement is not necessary for the function of the instant particle separator. Lower flow inlet 106 may be juxtaposed at levels either above or below the level of the mouth 205. In some embodiments, downspout 204 extends from a central orifice (e.g., orifice 301 in FIG. 3*a*) at the apex of substantially conical or sloped partition 203.

In some embodiments, tangential flow inlet 105 enters upper chamber 201 through opening 206 above the level of partition 203. Opening 206 directs a tangential flow as a stream or jet into upper chamber 201, where the tangential flow of liquid such as water, is directed substantially along a chord of the cross section of main body 102. In some embodiments, the chord is substantially tangent to the inner surface 207 of wall 102'. In some embodiments, a tube may extend from opening 206 into upper chamber 201.

Still referring to FIG. 2, feed tube 208 extends from feed inlet port 103 into upper chamber 201 In some embodiments, feed tube 208 extends below outlet port 104. In some embodiments, at least one groove 209 extends along inner surface 210 of wall 102' from within upper chamber 201, and terminating at the upper rim of partition 203. Along the upper surface of partition 203 are one or more grooves 211, which may be in register with grooves 209, according to some embodiments. In some embodiments, grooves 211 extend down the slope of partition 203 to open into downspout 206. In some embodiments, outlet flow port 104 is disposed above grooves 209 extending along inner surface 210.

Disposed below the level of mouth 205 and central flow inlet 106 is valve 212, represented here as the disc of a butterfly valve, affixed to valve stem 107, and actuated by handle 108. In other embodiments, valve 212 is a ball valve or a gate valve. In some embodiments, valve 212 is disposed above, but in proximity to, the bottom of main body 102. Valve 212 may be employed to seal off the bottom of main body 102 when accessing collection vessel 109. In some embodiments, collection vessel 109 is removed by unscrewing threaded interface 110 to recover accumulated high density particles that have been separated from lower-density particles. In some embodiments, collection vessel 109 is removed by unbolting from a flange (e.g., flange 701 in FIG. 7*b*).

Figure 3A:
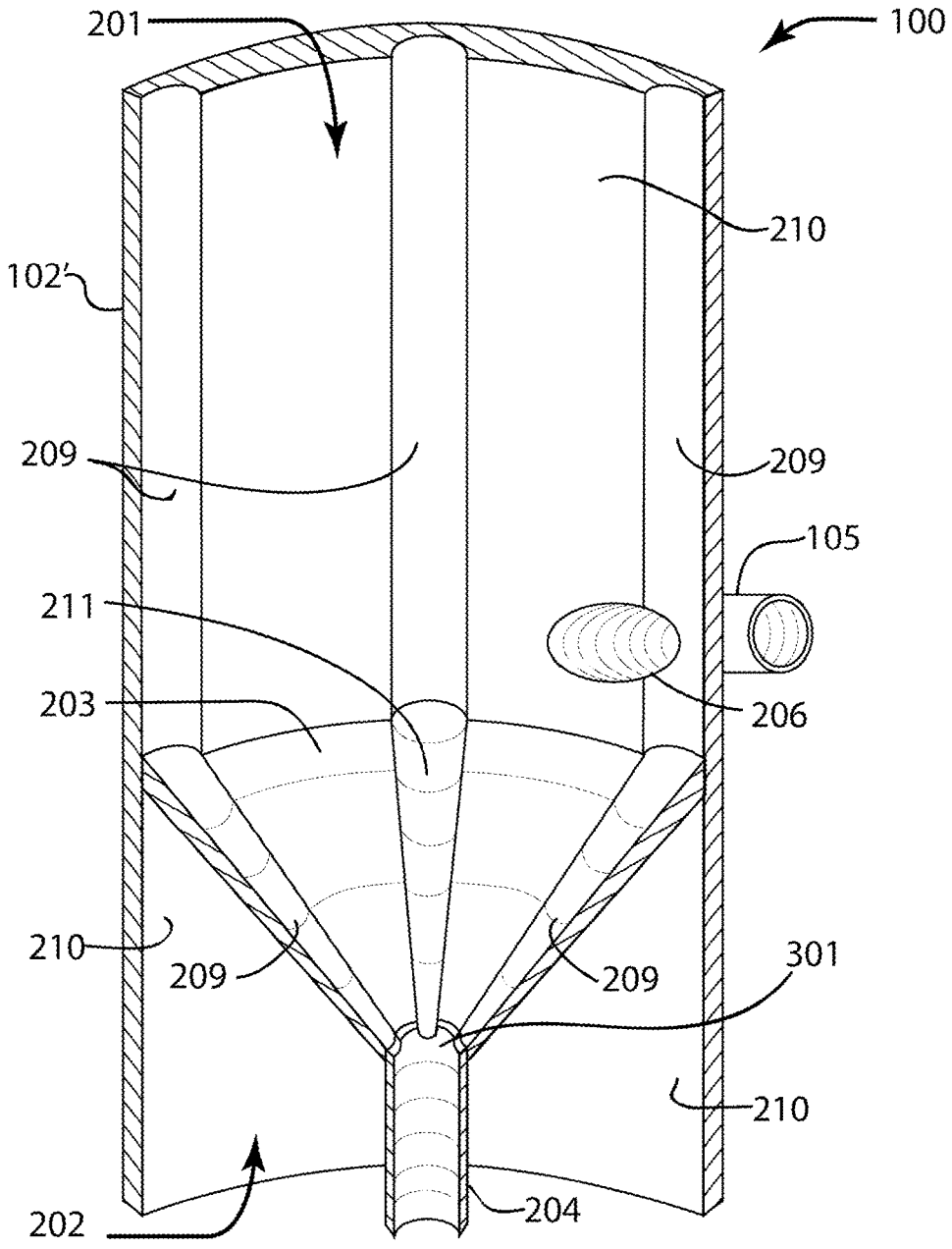
FIG. 3*a*. Sectional perspective view of upper and lower chambers of the cavity of the main body of the innovative particle separator apparatus separated by the partition, showing details of one embodiment of a particle-gathering partition and funneling partition with downspout leading into lower chamber, the instant embodiment having a plurality of grooves.

FIG. 3*a* shows a more detailed cross-sectional view of partition 203 of particle separator 100. Grooves 209 are shown distributed around the inner surface 210 of wall 102' enclosing the upper chamber 201 above partition 203. In some embodiments, grooves 209 are aligned with grooves 210 formed on the upper surface of partition 203. In other embodiments (not shown), grooves may not be included with partition 203, thereby allowing vertical grooves 209 to terminate at the upper rim of partition 203. In other embodiments, vertical grooves 209 may not be present on wall inner surface 210. In exemplary embodiments that comprise grooves 209, collection efficiency of high-density particles may be enhanced.

Figure 3B:
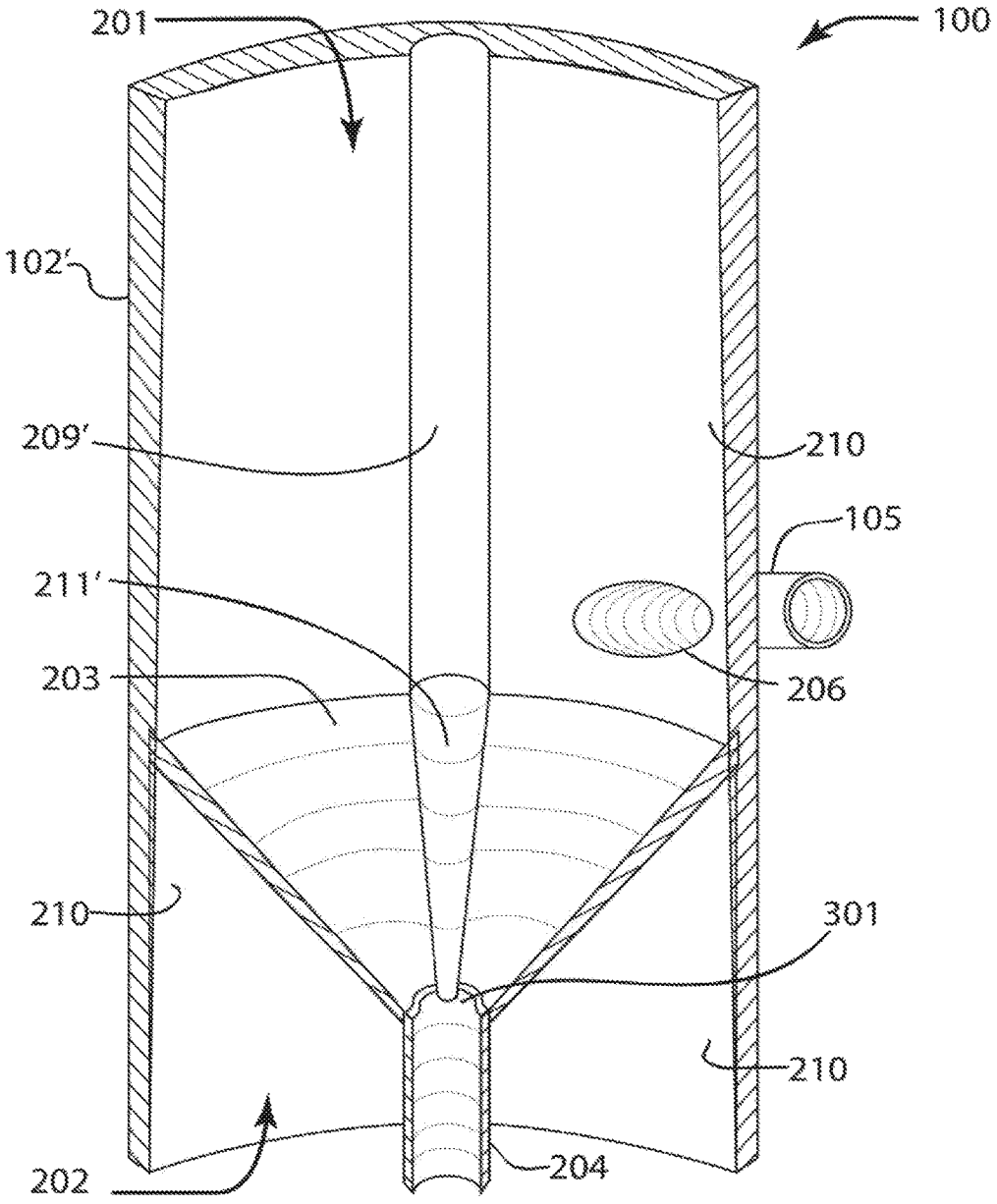
FIG. 3*b*. Sectional perspective view of upper and lower chambers of the cavity of the main body of the innovative particle separator apparatus separated by the partition, showing details of a second embodiment of a particle-gathering partition and funneling partition with downspout leading into lower chamber, the instant embodiment having a single groove.

In FIG. 3*b*, an alternative embodiment is shown, wherein a single groove 209' is disposed on inner surface 210. In some embodiments, groove 209' is aligned with single groove 211' on the surface of partition 203.

Figure 4:
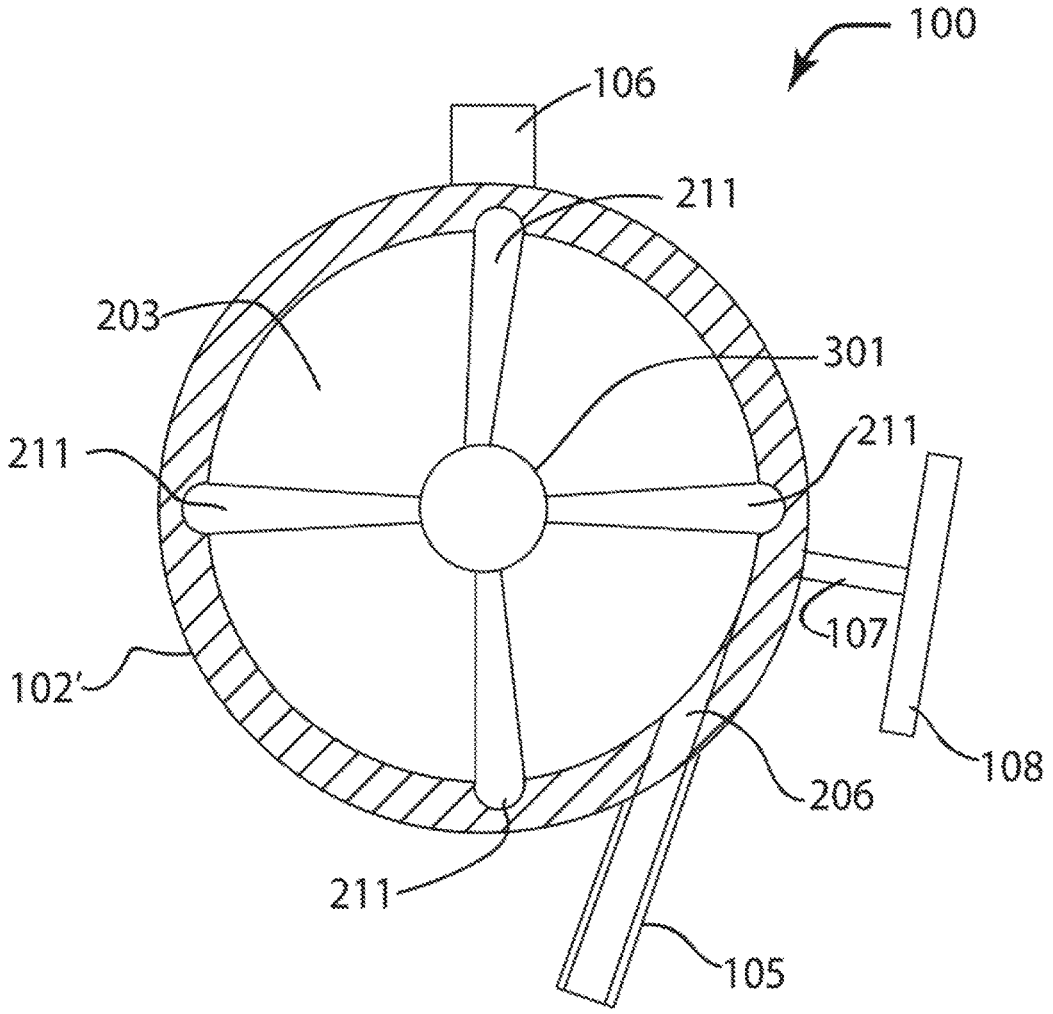
FIG. 4. Overhead sectional view from upper chamber of the main body of the innovative particle separator apparatus, looking down on the partition embodiment shown in FIG. 3. Section cuts through the tangential inlet, disposed above the partition.

FIG. 4 shows a top sectional view of the innovative particle separator 100. The view of FIG. 4 is taken above the level of partition 203 to show the top surface of partition 203. In this depiction, grooves 211 extend from the rim of partition 203 to orifice 301. The sectional view bisects the main body at the level of tangential flow inlet 105, showing the orientation of tangential flow inlet 105. Tangential flow Inlet 105 extends through wall 102' above the level of partition 203, and terminates at opening 206. Lower flow inlet 106 is below the level of partition 203. Valve stem 107 extends from wall 102' below the level of partition 203, terminating at handle 108.

Figure 5:
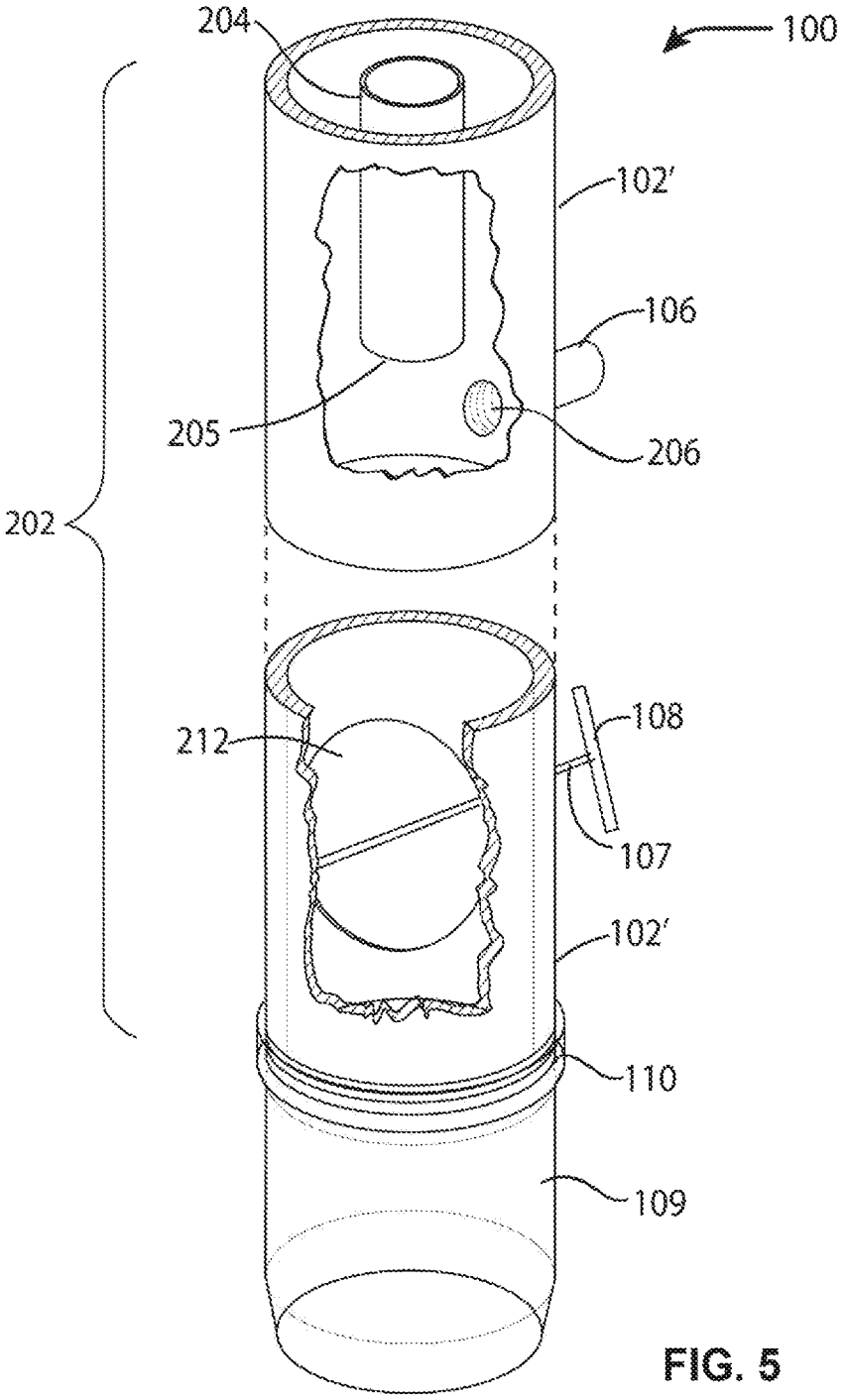
FIG. 5. Perspective and sectional views of lower chamber of the cavity of the main body, exposing arrangement of partition downspout, flow inlet and butterfly valve disc with respect to bottom of the main body.

In FIG. 5, a sectional view of the lower chamber 202 of particle separator 100, the section cut below the level of the partition (e.g., partition 203). What is viewed is a lower section of downspout 204. Below downspout mouth 205 is opening 206 of lower flow inlet 106 into lower chamber 202. Below opening 206 is a rotated view of valve 212, affixed to shaft 107 and handle 108. In the illustrated embodiment, valve 212 is a butterfly valve. In some embodiments, valve 212 is a ball valve. Below valve 212 is collection vessel 109 affixed to the bottom of main body 102 by threaded interface 110. In some embodiments, valve 212 is employed to seal lower chamber 202 when collection vessel 109 is removed from lower chamber 202.

Lower flow inlet 106 directs a stream of clear or clarified liquid (e.g., water) into lower chamber 202. The liquid introduced into lower chamber 202 may flow upward into the upper chamber (e.g., upper chamber 201 in FIG. 2) through downspout 204. Liquid introduced by lower flow inlet 206 may mix with liquid introduced by tangential flow inlet (e.g., tangential flow inlet 105 in FIG. 4) in the upper chamber (e.g., upper chamber 201 in FIG. 2).

Figure 6:
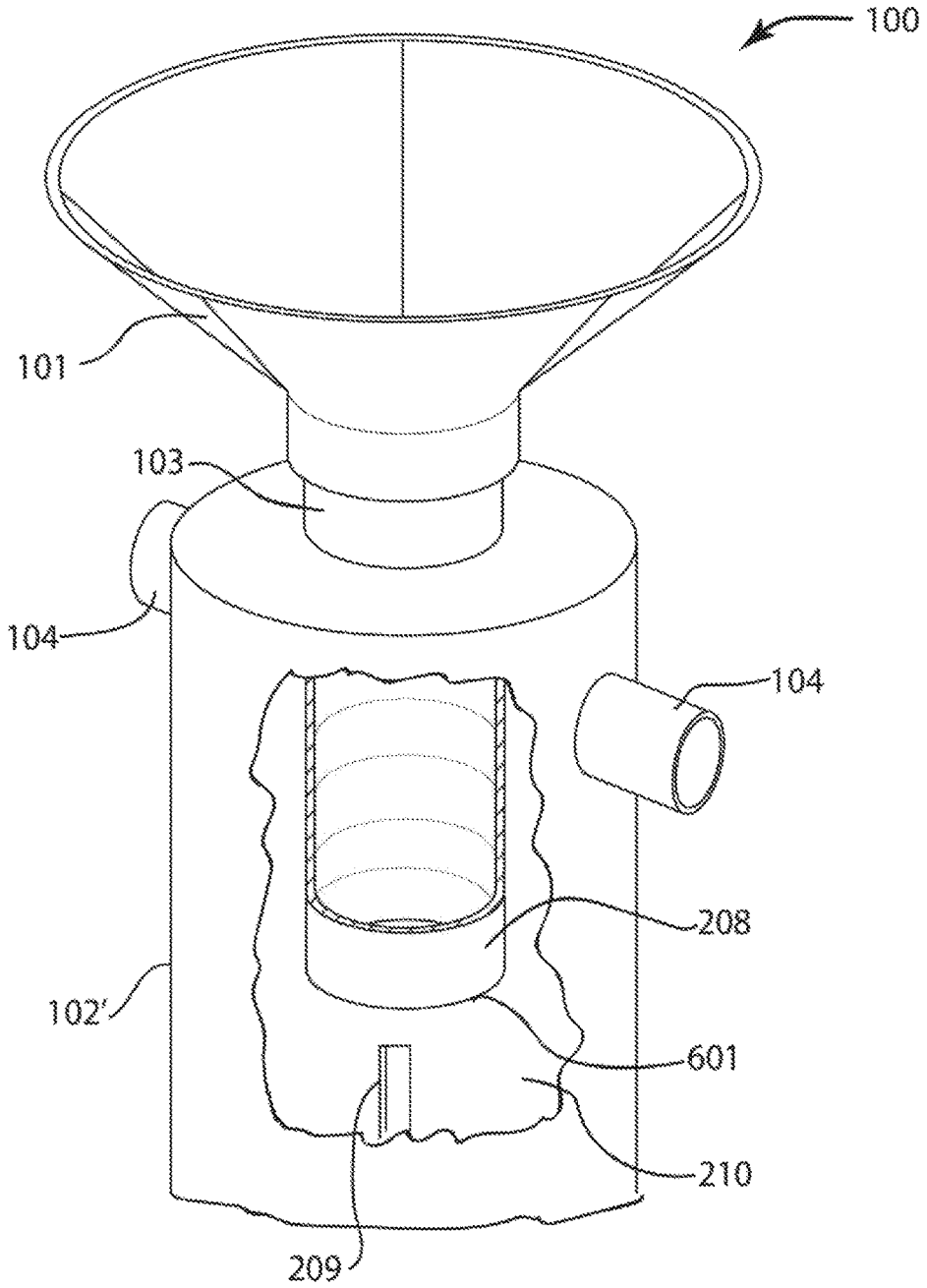
FIG. 6. Perspective and partial sectional views of the top of the main body and exposure of upper chamber of the cavity near the top. Exposed are the downspout from the hopper pan, and a part of a groove formed in the inner surface of the apparatus main body wall.

In the cutaway view of FIG. 6, upper chamber 201 of particle separator 100 is detailed. In the illustrated embodiment, hopper pan 101 is affixed to feed inlet port 103. In particular embodiments, hopper pan 101 is removably affixed by fitting over feed inlet port 103. In other embodiments, hopper pan 101 is removable. In other embodiments, hopper pan 101 is permanently attached to feed inlet port 103.

In some embodiments, feed inlet port 103 receives a fitting from a pump hose, where the pump may be a slurry pump for continuous or semi-continuous feed of raw material to the innovative particle separation apparatus. In the illustrated embodiment shown in FIG. 6, two opposed outlet conduits 104 are disposed above the level of downspout mouth 601. In other embodiments, more than two outlet ports 104 may be present. In other embodiments, a single outlet port 104 is present.

The vertical displacement of outlet ports 104 from downspout mouth 601 may be necessary to mitigate the premature exit of raw deposit silt entering from hopper 101 via downspout 208 before separation can take place. In some embodiments, downspout mouth 601 is above groove 209. Spiraling flow engendered below carries light silt with it to outlet ports 104. Heavier particles fall by gravity, but are carried laterally by the spiral flow to surface 210 of wall 102'. Heavier particles may accumulate within groove 209, enhancing the separation process, as described below.

Figure 7A:
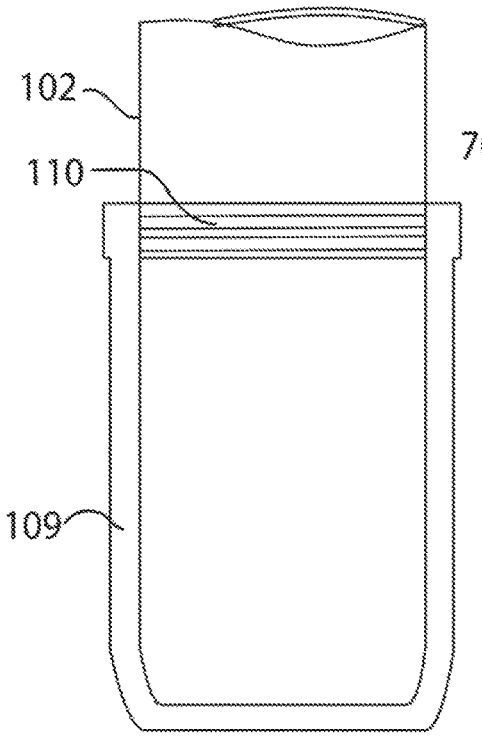
FIG. 7*a*. Detail view of the bottom of the main body of the innovative particle separator apparatus, showing an exemplary embodiment of collection vessel and means of attachment using a threaded interface.
Figure 7B:
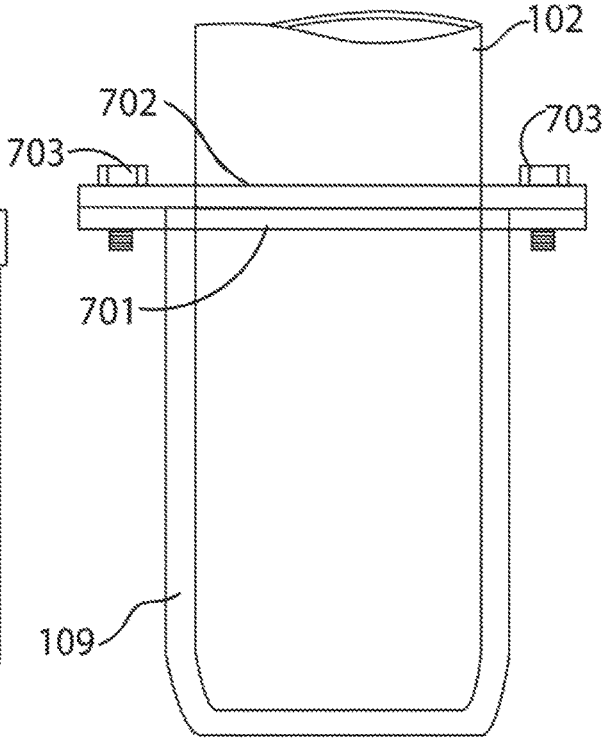
FIG. 7*b*. Detail view of the bottom of the main body of the innovative particle separator apparatus, showing an exemplary embodiment of the collection vessel and means of attachment using a bolted flange.

A view of two embodiments of collection vessel installations are shown in FIGS. 7*a* and 7*b*. In FIG. 7*a*, collection vessel 109 is affixed to the bottom of innovative particle separator main body 102 by threaded interface 110, shown in FIG. 7*a*. In some embodiments, threaded interface 110 comprises jar lid threads. In some embodiments, interface 110 comprises machine threads.

In FIG. 7*b*, collection vessel 109 is affixed to main body 102 by bolting to body flange 702 extending from the bottom of main body 102. In the embodiment depicted in FIG. 7*b*, flange 701 extends from the top of collection vessel 109. In some embodiments, flange 701 is integral with collection vessel 109. In some embodiments, flange 701 is bolted to body flange 702 with bolts 703. Collection vessel 109 may be fabricated from a transparent or semi-transparent material such as glass, or a polymer such as polycarbonate or polypropylene.

An exemplary method of use for particle separator 100 is now described. In some embodiments, particle separator 100 is used for separation of high density particles from low density particles in solids mixtures. Gravity separation of particles may be performed in particle separator 100 in suitable liquids. In the exemplary operation described below, particle separator 100 is operated for placer gold mining. For manual operation, a hopper or pan, as, by way of example, indicated by item 101 in FIGS. 1, 2 and 6, is provided. Hopper pan 101 is filled with placer silt by a human operator, or may be disposed to receive the placer silt by more automated means. The placer silt may be introduced as a slurry mixture with water. Other means for providing placer silt may be provided.

Figure 8:
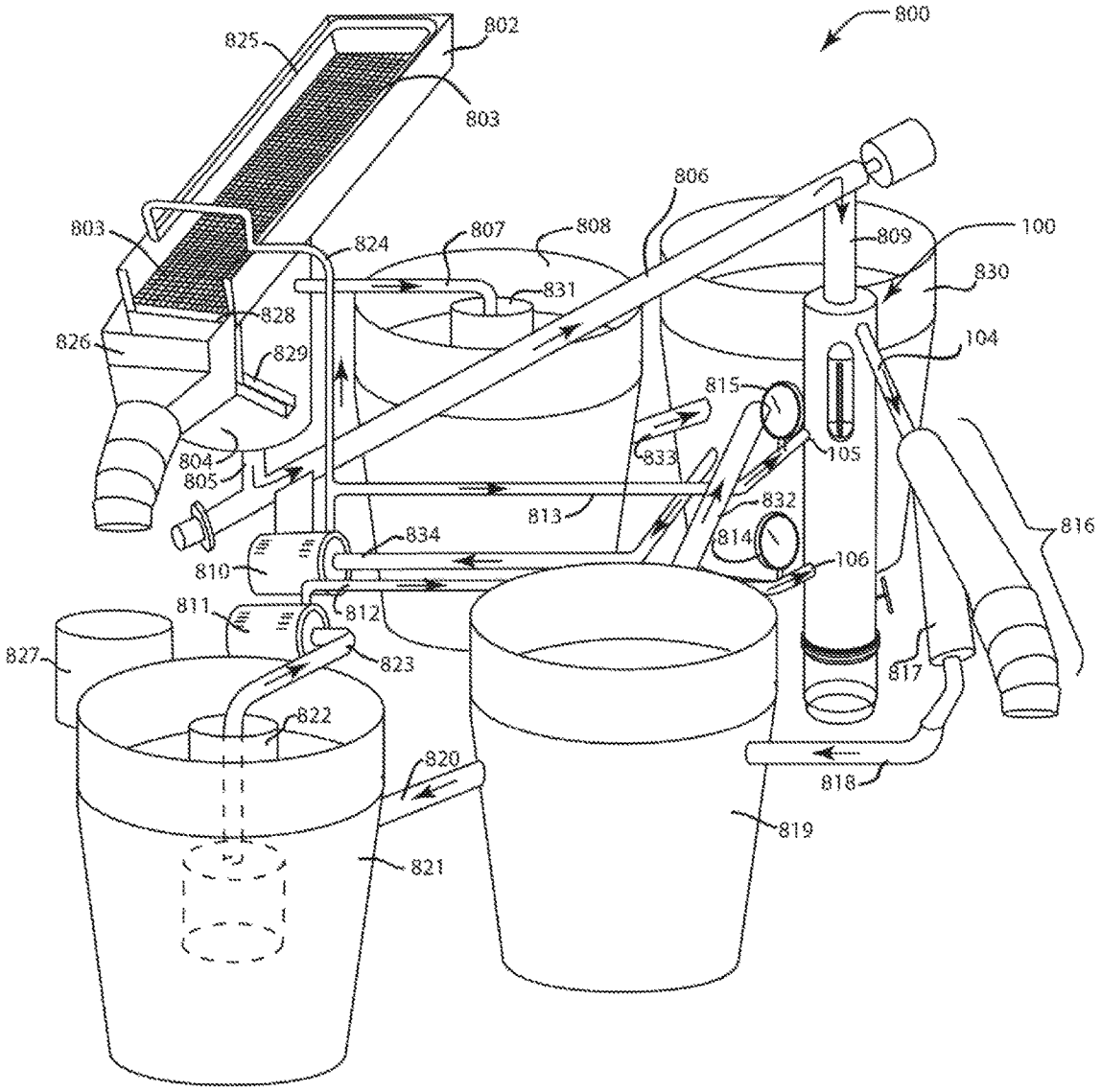
FIG. 8. Depiction of one example of deployment of the innovative particle separation apparatus using a series of silt and water-containment vessels, conduits and a auger mechanism to convey silt slurry to the particle separation apparatus.

In FIG. 8, an exemplary self-contained particle separator system 800 comprising particle separator 100 is shown. In some embodiments, system 800 employs sluice box 802 for receiving placer dirt. In some embodiments, sluice box 802 is lined with matting mesh 803, to allow fine material and water to fall through the mesh into hopper 804. A partial crude separation of liquid and solids may take place within hopper 804, where a substantial portion of solids may settle to the bottom, falling through throat 805 into auger screw casing 806. Partially clarified water filling hopper 804 may exit via conduit 807 into a first settling vessel 808. Auger 806 is disposed to carry a slurry of placer dirt to the top of particle separator 100. The placer dirt is processed internally in the innovative particle separator apparatus as described previously for its various embodiments.

System 800 relies on one or more pumps to circulate water between multiple settling vessels and particle separator 100. In some embodiments, system 800 is self-contained in that all of the water required for operation of particle separator 100 is contained within the vessels, and does not need to be replenished from an external source. In the embodiment depicted in FIG. 8, water is supplied to particle separator 100 via pumps 810 and 811 and conduits 812 and 813. Conduit 812 supplies pumped filtered water to lower chamber inlet 106 treated through a fine filter (described below). Conduit 813 supplies pumped partially clarified water to tangential flow inlet 105.

As shown in FIG. 8, flow or pressure meters 814 and 815 may be used to monitor water flow rates into both chambers. Valves (not shown) may be mounted in line with conduits 812 and 813 to regulate flow rates. Meters 814 and 815 are in fluidic communication with conduits 812 and 813, respectively. Return water exits particle separator 100 via outlet port 104. Exit water flow bearing low density particulates and stones is directed to flow through flow splitter 816, where water and fine particulates are separated from coarser material, such as stones, by a mesh or other filter medium fitted at the junction of the two branches of flow splitter 816. In some embodiments, flow splitter 816 is a PVC pipe T-section or angle elbow fitting. Water and fines exiting particle separator 100 are then directed to flow into conduit 818, leading into settling vessel 819. Partially clarified overflow from vessel 819 then flows out via conduit 820 to a fourth settling vessel 821.

Within settling vessel 821, a separation tube 822 encases a fine filter medium, revealed by the hidden lines, wherein separation tube 822 aids in separation of remaining course particulates from the water, permitting water to flow into the cavity of tube 822 while particulates may settle outside of separation tube 822. Water within settling vessel 821 may be caused to infiltrate a fine filter cartridge (e.g., 2 micron) by suction created by pump 811. Filtered water circulates though pump 811 via conduits 823 and 812, where conduit 812 connects with inlet 106 and supplies filtered and clarified water to the lower chamber of particle separator. It should be noted that clean water supplied to the lower chamber is an embodiment enhancement, as separated gold flakes and small nuggets captured in the lower chamber are not remixed with silt particles.

In the embodiment depicted in FIG. 8, portable sluice box 802 comprises a water spray system for washing placer dirt fines that are small enough to fall through matt 803 and collect in hopper 804, and washing larger rocks and nuggets to the edge of sluice box 802. Water is supplied to the spray system comprising conduit 824, carrying pressurized water from pump 810, into perforated conduit 825. The latter extends around the perimeter of sluice box 802 as shown. Larger materials that are too large to fall though matting mesh 803 may then washed to the bottom edge of portable sluice box 802, where discharge chute 826 is attached to receive rocks and guide their removal into bucket 827. Smaller nuggets may fall into slot 828, and may roll out on ramp 829 for collection.

The exemplary deployment shown in FIG. 8 provides for recycling water used for the separation process. System 800 comprises four water-containing settling vessels 808, 819, 821 and 830, where vessel 808 is adapted to receive the partially clarified water overflowing from hopper 804. To enhance clarification, clarifier tube 831 surrounds conduit 807 that conducts overflow water from hopper 804 to confine settled silt within tube 831, and allow partially clarified water to flow into settling vessel 808. Overflow from vessel 808 flows into settling vessel 828 via interconnecting conduit 832. Water is further clarified in settling vessel 828.

Overflow water from settling vessel 819 is also carried to settling vessel 828 via interconnecting conduit 833. Partially clarified water collected in settling vessel 828 is sucked into conduit 834 and pumped via pump 810 to be redistributed by the manifold comprising conduits 813 and 824, leading to tangential flow inlet 105 and wash water spray conduit 825.

Operation of particle separator 100 is now described. Referring to FIGS. 1-6, clarified water filling the lower chamber of cavity 202 flows into upper chamber 201 to fill it through one or more orifices 301 disposed in partition 203. In particular embodiments, water flowing into lower chamber 202 of the cavity flows into partition downspout mouth 210, up through partition downspout 206, and into upper chamber 201 of the cavity. Within upper chamber 201, the upward-directed flow emerging from partition 203 encounters tangential flow of water that is introduced via tangential flow inlet 105 above partition 203. This confluence engenders an upward-directed spiral flow that exits the innovative particle separator main body 102 via the at least one flow outlet 104.

By attaching hoses or conduit to tangential flow and lower inlet ports 105 and 106, respectively, where the hoses may be attached to pumps 810 and 811 pumping water into lower and upper chambers 201 and 202, respectively. Water introduced into lower chamber 202 through lower inlet port 106 flows into upper chamber 201 through partition 203. Flow entering upper chamber 201 mixes with tangential flow introduced by tangential flow inlet 105, establishing an upward spiral flow in upper chamber 201. In some embodiments, partially clarified water is pumped by pump 810 and conduit 813, which may be a rigid pipe or a flexible hose, to upper chamber 201 through tangential flow inlet 105.

In some embodiments, filtered water is pumped to the lower chamber via pump 811, conduit 812 and inlet 106, for vertical flow within lower chamber 202, up through partition 203 and into upper chamber 201 to meet with the tangential flow. By mixing with clarified water introduced into lower chamber 202, spiral flow in the upper chamber 201 is established. In some embodiments, adjustment of the individual water pressures and/or flow rates by use of valves (not shown), impingement forces of vertical and tangential flows may be likewise adjusted.

According to some embodiments, water pressure in the main body lower chamber 202 may be adjusted to force an exclusively upward flow into main body upper chamber 201 through partition downspout 206, whereby this vertical flow impinging on high-density particles does not entrain at least a majority of these particles that fall through downspout 206. In upper chamber 201, tangential flow introduced mixes with the upward flow emerging from partition 203, creating an upwardly spiraling flow, and the total flow, which is the sum of the two inlet flows, exiting the innovative separation apparatus via exit one or more outlets 104. The flow rate of water emerging from partition 203 is equal to the flow rate of water introduced via inlet 106. According to the innovation, the static pressure in lower chamber 202 is greater than the pressure in upper chamber 201 so that no downward flow may occur.

High-density particle-bearing silt, for example from a placer deposit, may be introduced batch-wise into upper chamber 201 through auger 806, in dry or slurry form. The raw placer silt may be introduced by a number of means. If the silt is wet, it may form its own slurry, with wash water added by conduit 825. In some embodiments, a silt may be dredged and conveyed (e.g., by a dredging machine or conveyer belt) continuously to sluice box 802 or an equivalent receiving structure. The dredged silt may require premixing with water to liquefy the silt enough so that it may easily enter the innovative apparatus. In other circumstances, the placer silt may be introduced as a loose sandy material, and be metered into main body 102 without need to form a wet slurry.

By whichever means the raw silt is introduced into the innovative particle separator, the solids and particulates begin the separation process upon contact with the spiral flow occurring within upper chamber 201 simultaneously with the introduction of solids. As the majority content of most high-density particle (gold flake and small nuggets) silt deposits is composed of low-density silica sand and clay particulates, the spiral flow is adjusted so that it readily carries low-density particulates and other matter upwards immediately upon contact with the upwardly spiraling flow, but allow high-density particulates to fall by gravity towards the lower chambers of particle separator 100. In some embodiments, the separation is instantaneous.

The spiral pattern of water flow adds lateral and tangential components to downward migrating high-density particulates' trajectories, and may cause many of them to spiral toward the wall inner surface 210. Along this surface, the flow velocity is lower than at the center, and the high density particles may be overtaken once again by gravity and fall downwards. As described above, one or more grooves 209 may be provided in some embodiments, disposed along wall inner surface 210 that extend vertically along wall inner surface 210 to partition 203.

The one or more grooves 209 serve to channel the high-density particles in the vicinity of wall inner surface 210, mitigating any propensity of the particles to reenter the spiral fluid flow as the grooves are sunk below the level of wall inner surface 210, effectively shielding then from the force of the swirling fluid. The one or more grooves 209 serve to collect and concentrate high-density particles that are driven by the spiral flow against wall inner surface 210, shielding them from tangential fluid forces, and allow the particles to move under gravity. According to the innovation, their (the high-density particles) collection into lower chamber 202 of the cavity is facilitated, providing a high-efficiency particle separation.

In embodiments of the innovation, high-density particles that are separated in the spiral flow are gravity-fed towards partition 203. In the embodiments described above, partition 203 may comprise a conical shape, or have sloped surfaces, such that high-density particulates impinging on the upper surface of partition 203 may slide toward central orifice 301 in the featured embodiment, into downspout 204. From there, high-density particles fall against upward fluid flow, where the impinging upward flow through downspout 204 does not entrain the high-density particles.

The high-density particles are thus free to fall through downspout 204 and out of mouth 601 into cavity lower chamber 202. As the flow may have no tangential components (substantially not spiral, according to the innovation) in lower chamber 202, and as such may be much slower and less chaotic compared to flow in upper chamber 201, high-density particles may settle unimpeded into collection vessel 109 affixed to the bottom of main body 102. High-density particles thus collected may be recovered by removing collection vessel 109 from main body 102. Embodiments of the innovation may comprise valve 212 to seal off the cavity of main body 102 when collection vessel 109 is removed. As described above, a valve such as a gate or butterfly valve may be used to embody this function.

Particle separator 100 permits the separation to continue to take place uninterrupted while collection vessel 109 is sealed off by use of valve 212 and removed. High-density particles having fallen through partition 203 may then settle on valve 212 while it is closed. When one batch of particles is recovered, collection vessel 109 may be re-mounted, and valve 212 reopened, allowing high-density particles to resume their journey and settle in collection vessel 109.

According to the innovation, exit, or waste stream flow carries out lower-density particulates and silt material, such as sand, clays and minerals, including small stones, via split conduit 816, which in the depicted embodiment of FIG. 8, is a branched pipe such as a an elbow fitting, and drops the coarser components into a collection bucket or other vessel (not shown), while the exit water stream mostly drops into the lower branch of split conduit 816, carrying with it fine low-density silt that has been separated from high-density components into settling vessel 819 via interconnecting conduit 818.

The separation of lower-density material from the desired high-density materials, such as gold flake and small nuggets, in this example of use of the innovative particle separator apparatus in placer mining, is substantially instantaneous within the cavity of the instant innovation, and accordingly, occurs close to the top of main body 102. As disclosed above, raw placer material may be introduced near the one or more outlet ports 104 disposed at the top of the innovative apparatus, thus allowing entrained lower-density particulates and matter to be rapidly removed from the apparatus. Exit fluid may be discharged directly to a water source, such as a stream, with or without an attached hose.

According to the scheme depicted in FIG. 8, coarse or partial clarification may take place within vessel 819 by settling of particulate matter. This partially clarified water may be cascaded from vessel 819 to vessel 821 via interconnecting conduit 820, where vessel 821 serves as a second stage settling tank or vat. A filter element may be immersed in the partially clarified water within settling vessel 821, which filters water that is actively pumped out of this vessel by pump 811, supplying clean water to the vertical flow inlet 106. Overflow water from settling vessel 819 is also transferred to settling vessel 830, which receives overflow from settling vessel 808, also serving as a second settling stage. In turn, partially clarified water from settling vessel 830 is pumped via pump 810 to both upper chamber via tangential flow inlet 105 and to the It will be appreciated by persons skilled in the art that the embodiments disclosed herein are exemplary and are by no means to be construed as limiting. Other variations of the described embodiments may be considered without deviating from the scope and spirit of the innovation, as claimed in the claims below.

The invention claimed is:

1. A hydraulic particle separator, comprising:

a main body having a top, a bottom, a cavity extending downward from the top through the bottom, and a wall having an interior surface surrounding the cavity, a partition disposed within the cavity, wherein the partition separates the cavity into a lower chamber and an upper chamber, and wherein the partition has at least one opening between the lower chamber and the upper chamber;

one or more grooves on the interior surface of the wall and extending vertically therealong within the upper chamber, wherein the one or more grooves are substantially aligned with one or more grooves disposed on the upper surface of the partition at least one tangential flow inlet port disposed along the wall of the upper chamber above the partition, wherein the tangential flow inlet port is to direct a flow of clear liquid tangentially into the upper chamber to engender spiral flow within the upper chamber; and at least one feed inlet port disposed on the top of said main body and in fluidic communication with the upper chamber of said cavity, wherein the inlet port is to direct solid particulate-containing fluid stream into the upper chamber.

2. The hydraulic particle separator of claim 1, wherein the main body is substantially tubular, and wherein the main body has a substantially vertical orientation.

3. The hydraulic particle separator of claim 1, wherein the partition is substantially conical.

4. The hydraulic particle separator of claim 1, wherein the partition is substantially a flat plate spanning the cross section of the cavity.

5. The hydraulic particle separator of claim 4, wherein at least a portion of the partition is sloped.

6. The hydraulic particle separator of claim 1, wherein at least one downspout is affixed to the partition, and wherein the at least one downspout extends downward into the lower chamber from the at least one orifice of the partition.

7. The hydraulic particle separator of claim 1, further comprising at least one flow outlet port disposed along the upper chamber wherein the at least one flow outlet port is substantially near the top of the upper chamber.

8. The hydraulic particle separator of claim 1, further comprising a collection vessel attached to the bottom of said main body, wherein the collection vessel is removable.

9. The hydraulic particle separator of claim 1, further comprising a valve disposed within the lower chamber of the cavity of the main body, wherein the valve is to seal the lower chamber of the cavity between the partition and the bottom of the main body.

10. The hydraulic particle separator of claim 1, wherein at least one transparent window is in the wall of the main body.

11. The hydraulic particle separator of claim 1, wherein the feed inlet port is coupled to one of a hopper pan or a conduit coupled to a pump.

12. The hydraulic particle separator of claim 1, wherein a flow inlet is disposed on the top of the main body, and wherein the feed inlet port is coupled to an auger.

13. The hydraulic particle separator of claim 1, wherein at least one outlet flow port is disposed on the wall of the main body in the vicinity of the top of the upper chamber, and wherein the at least one outlet flow port is disposed above the one or more grooves on the interior surface of the upper chamber.

14. The hydraulic particle separator of claim 13, wherein a feed tube extends downward into the upper chamber from the at least one feed port and terminates between the level of the at least one outlet flow port and the level of the tangential flow inlet port.

* * * * *